United States Patent [19]

Mitchell

[11] Patent Number: 4,628,861

[45] Date of Patent: Dec. 16, 1986

[54] METERING AND PROPORTIONING SYSTEM FOR A TWO-COMPONENT LIQUID RESIN AND LIQUID HARDENER ADHESIVE

[75] Inventor: David K. Mitchell, Kent, Wash.

[73] Assignee: Chembond Corporation, Springfield, Oreg.

[21] Appl. No.: 807,946

[22] Filed: Dec. 12, 1985

Related U.S. Application Data

[63] Continuation of Ser. No. 506,272, Jun. 21, 1983, abandoned.

[51] Int. Cl.[4] ..... B05B 13/00; B05B 12/00

[52] U.S. Cl. ..... 118/684; 118/692; 118/300

[58] Field of Search ..... 118/672, 684, 692, 300

[56] References Cited

U.S. PATENT DOCUMENTS

| | | | |
|---|---|---|---|
| 2,488,519 | 11/1949 | Andrews et al. | 118/684 |
| 2,788,337 | 4/1957 | Preiswerk et al. | 260/37 |
| 3,105,745 | 10/1963 | Vieli | 23/252 |
| 3,252,441 | 5/1966 | Hargreaves | 118/684 |
| 3,765,605 | 10/1973 | Gusmer et al. | 239/61 |
| 3,811,405 | 5/1974 | Baker | 118/692 |
| 4,389,971 | 6/1983 | Schmidt | 118/684 X |

FOREIGN PATENT DOCUMENTS 3013733 10/1981 Fed. Rep. of Germany ..... 118/692

*Primary Examiner*—Shrive P. Beck

*Attorney, Agent, or Firm*—Raymond N. Baker

[57] ABSTRACT

A new metering and proportioning apparatus for directly applying a two-component adhesive in a wood laminating process is described. The key element of the invention is a valve system regulating flow of resin and hardener to and from double-acting cylinder pumps. The new system eliminates conventional spool valve difficulties. Each component cylinder pump is supplied with a pair of 3-way ball valves which are manifolded to direct component flows. A pneumatic control system senses completion of a component discharge stroke and causes simultaneous reversal of the ball valve pair for discharge of component and refilling of the emptied side of the cylinder on the return stroke. A two-level optical sensor detects a workpiece and opens extruder head discharge. The sensor operates a modulating valve in the resin supply line as the workpiece proceeds ensuring even spread rate. A staged shutdown of the system occurs when the sensor detects the trailing edge of the workpiece which insures that the delivery system remains under pressure and that no overrun or post-application oozing takes place.

1 Claim, 5 Drawing Figures

STATE OF ART

Fig. 4
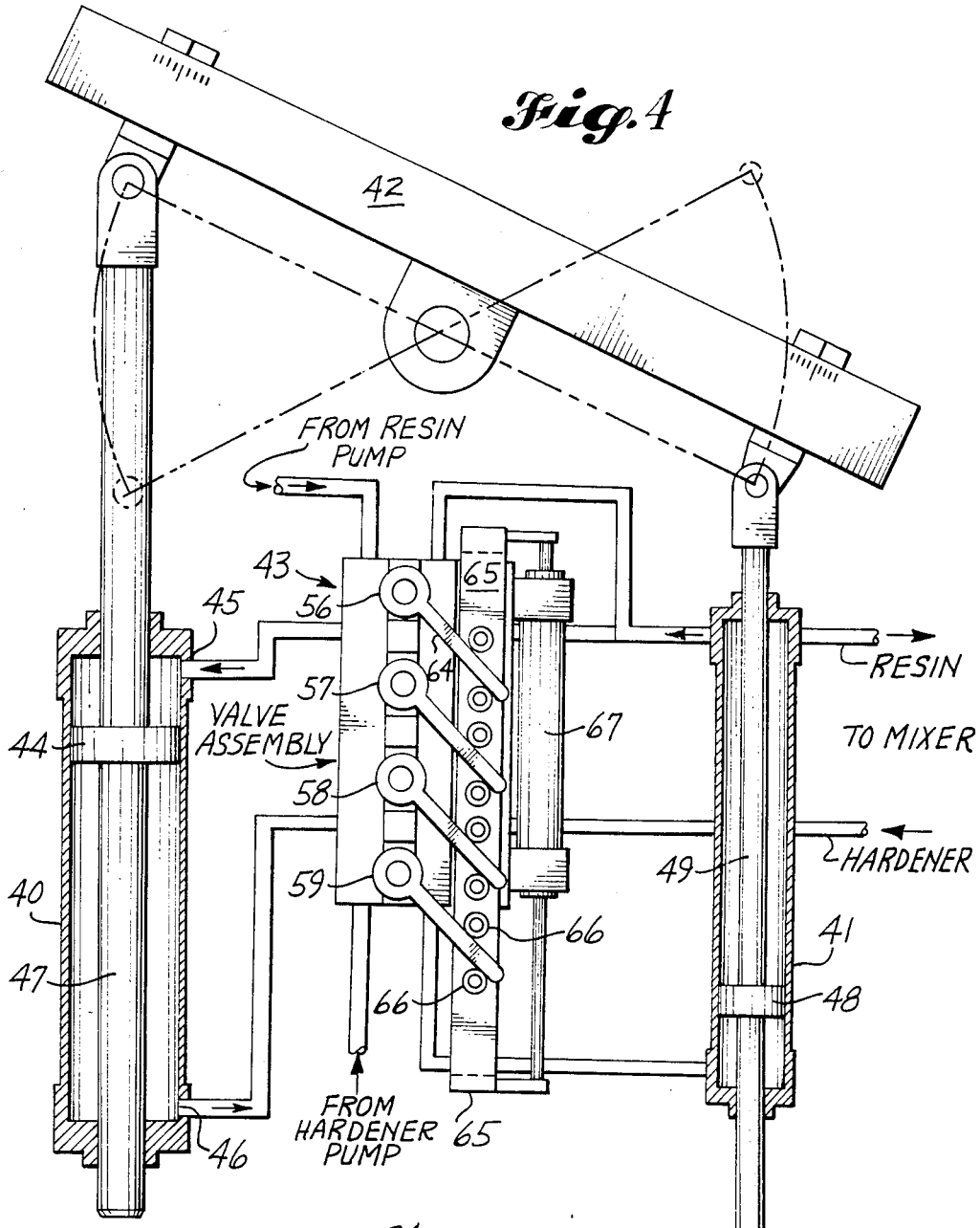
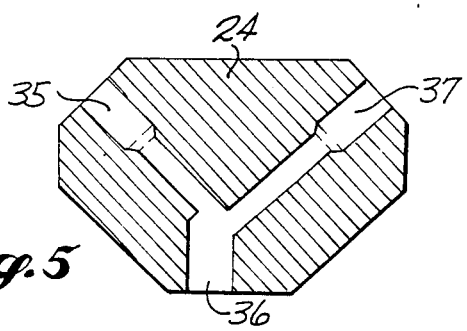
Fig. 5

METERING AND PROPORTIONING SYSTEM FOR A TWO-COMPONENT LIQUID RESIN AND LIQUID HARDENER ADHESIVE

This is a continuation of application Ser. No. 506,272, filed June 21, 1983, the entire disclosure of which is incorporated herein by reference, now abandoned.

BACKGROUND OF THE INVENTION

1. Field of the Invention

The apparatus of this invention is designed to combine the liquid components of a mixture in accurate proportions. More specifically, a two-component adhesive system, including a resin and a solid hardener in water slurry is metered and proportioned.

2. Prior Art

In the production of laminated structural beams and other such products, it is necessary to produce an adhesive for face bonding the wood components together. The adhesive must be accurately made so that the finished products will meet critical load bearing specifications. A typical adhesive requires metering and mixing of a phenol-resorcinol resin with a liquid hardener slurry. Critical to resin performance is insuring the resin to hardener ratio is correct.

A major difficulty with the typical hardener is that it is abrasive and, in the water slurry form necessary for accurate flow control, causes such wear in conventional metering equipment that the critical ratios of hardener to resin are extremely difficult to maintain. The result can be laminated beams that fail design tests and sometimes even fail in use under load.

The prior art is also characterized by erratic control of adhesive from the metering-mixing apparatus. These control problems are caused by poor control strategies and inherently poor cleanup capability of the apparatus itself. Erratic spread rates and inability to start and stop adhesive flow as the workpiece leaves an extruder head are difficulties. Poor cleanup capability results in excess downtime for cleaning to maintain proper operation.

Both control and cleanup problems cause most adhesive system operators to use indirect application equipment. In these operations, the metering/mixing system discharges into a resin holding tank. A separate pump receives adhesive from the holding tank and dispenses it through an extruder head onto the workpiece. Not only does the indirect approach require capital, but adhesive losses are substantially increased as a result of added volumes that are circulated and the limited pot life of the adhesive.

A state-of-the-art liquid dispensing system is shown in FIG. 1. A hydraulic cylinder 1 dispenses a quantity of adhesive from a cylinder chamber 2 through a port 11 as the cylinder head 12 moves downwardly. The liquid component passes through a spool valve 15, specifically through ports 16, and proceeds, after mixing with other components, to application onto a workpiece. Simultaneously with discharge, the spool valve 15 admits through ports 17 liquid component, from a pressurized supply (not shown), into a hydraulic chamber 3 through a cylinder port 13. The cylinder chamber 3 fills as the cylinder head 12 proceeds downwardly. As soon as the desired amount of liquid is dispensed a spool rod 18 moves upwardly so that spool elements 19 occupy the position shown of dashed line spool element 19'. After the spool rod shifts, cylinder head 12 reverses direction, moving upwardly, now dispensing liquid component from chamber 3 through port 13. Chamber 2 receives a new supply of component on the upward stroke.

One commercial adhesive metering system includes two of the metering double acting cylinders 1 of FIG. 1, one each for delivery of resin and hardener. The cylinders are sized and interconnected through a centrally pivoted beam operated so that each rotation of the beam delivers an increment of resin and hardener properly proportioned for an adhesive application. Two spool valves 15 of the type shown in FIG. 1 control flows. However, each cylinder 1 and valve 15 has a number of sealing means 4 which are serious trouble spots in this arrangement. The liquid component can build up on cylinder and valve walls and work into the sealing means. This material, particularly if abrasive hardener, tends to rapidly wear seals, walls and operating spool or cylinder elements quickly, enabling component material to bypass the seals. The end result is what is really an inherent inability of conventional equipment to maintain critical ratio relationships.

SUMMARY OF THE INVENTION

The invention includes a control system permitting direct applications of an adhesive to a workpiece as needed without edge overspread and excessive variability in spread rate. The system includes a dual channel optical sensor monitoring workpiece position. One channel operates a pneumatic-operated ball valve on the extruder head. The other channel of the sensor operates a modulating pneumatic-operated ball valve positioner with the valve located on the resin line very near discharge of the resin from a metering unit. The system keeps the lines under pressure at all times preventing post-application oozing and dripping.

A metering-proportioning unit is a key element of the invention. It includes a double acting cylinder pump for each mixture component. Proportions are set through an interconnecting pivoted beam. The driving forces for the system are the component supply pressures which cause the system to operate when the extruder head valve is opened. A unique valve system controls flow in and out of the cylinders between component supply and the downstream mixing process.

Each cylinder pump is supplied with two 3-way ball valves. Each 3-way valve has one port connected to a manifold receiving component from the supply pumps and a second port connected to a manifold discharging component to the mixing process. The third port of one valve is connected to one side of the cylinder pump. The third port of the other valve is connected to the opposite side of the cylinder. The 3-way valves are handle operated. The handles are arranged so that both valves can be reversed together, which reverses flow of component to and from the cylinder. A control means senses when the beam completes a pumping cycle. This control means then forces a reversal of the 3-way valve operation. Thus, on each complete rotation or cycle of the beam both sides of the cylinder discharge to the mixing and subsequently to the application process. This cycle is repeated continuously as long as the extruder valve is open.

Key to long-term operation of the invention is pressure lubrication of gland bearings and a water purge on cylinder piston seals. Such systems prevent buildup of abrasive material on walls and infiltration into bearings and seals.

The mixing head of the invention is supplied with a solvent-air cleaning system which eliminates downtime for cleanout. A special design of the mixing head prevents backflow of resin into hardener supply channels.

BRIEF DESCRIPTION OF THE DRAWINGS

FIG. 4 is a sectional view of the metering unit valve assembly.

FIG. 5 is a sectional view of the apparatus mixing head.

DESCRIPTION OF THE PREFERRED EMBODIMENT

Figure 1:
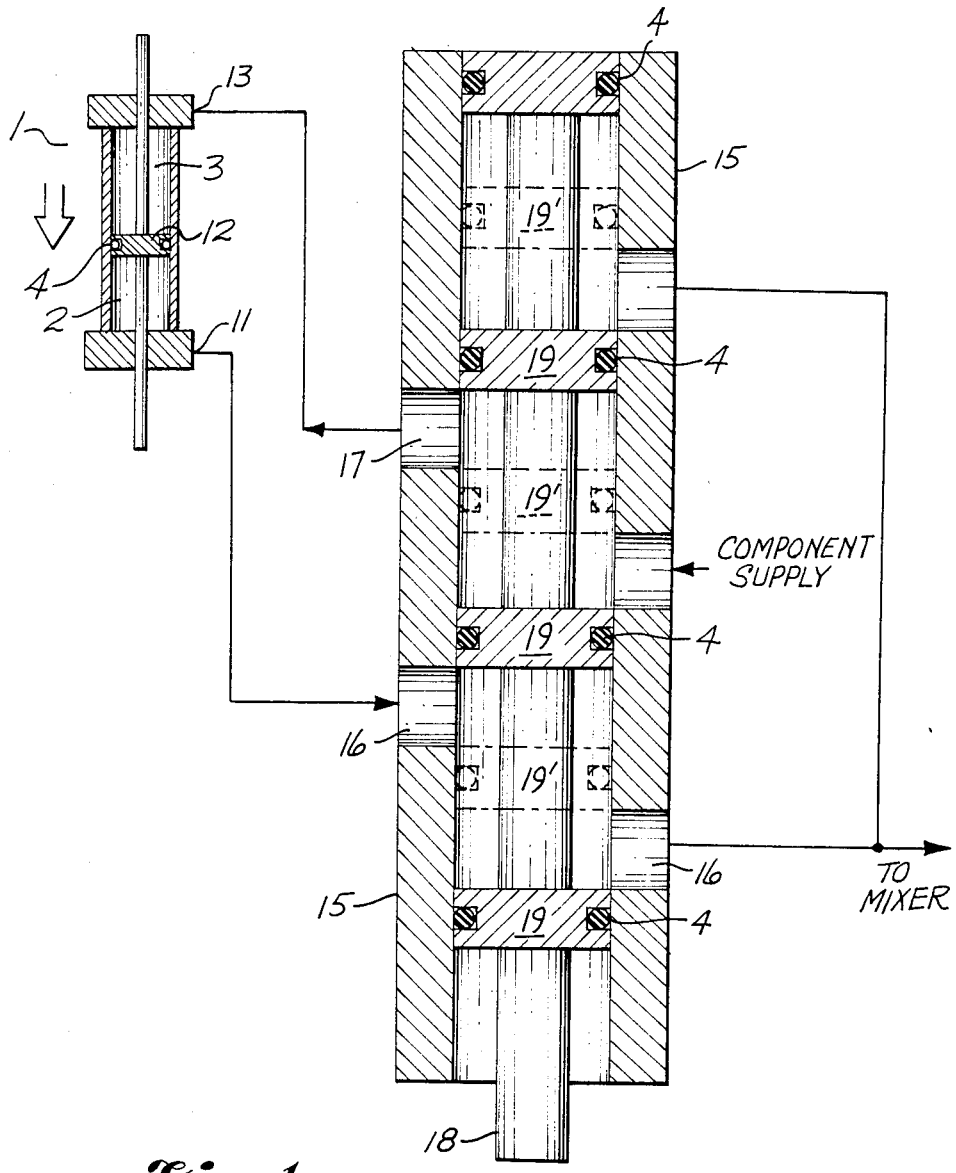
FIG. 1 depicts a portion of state-of-the-art cylinder pump and spool valve controls.
Figure 2:
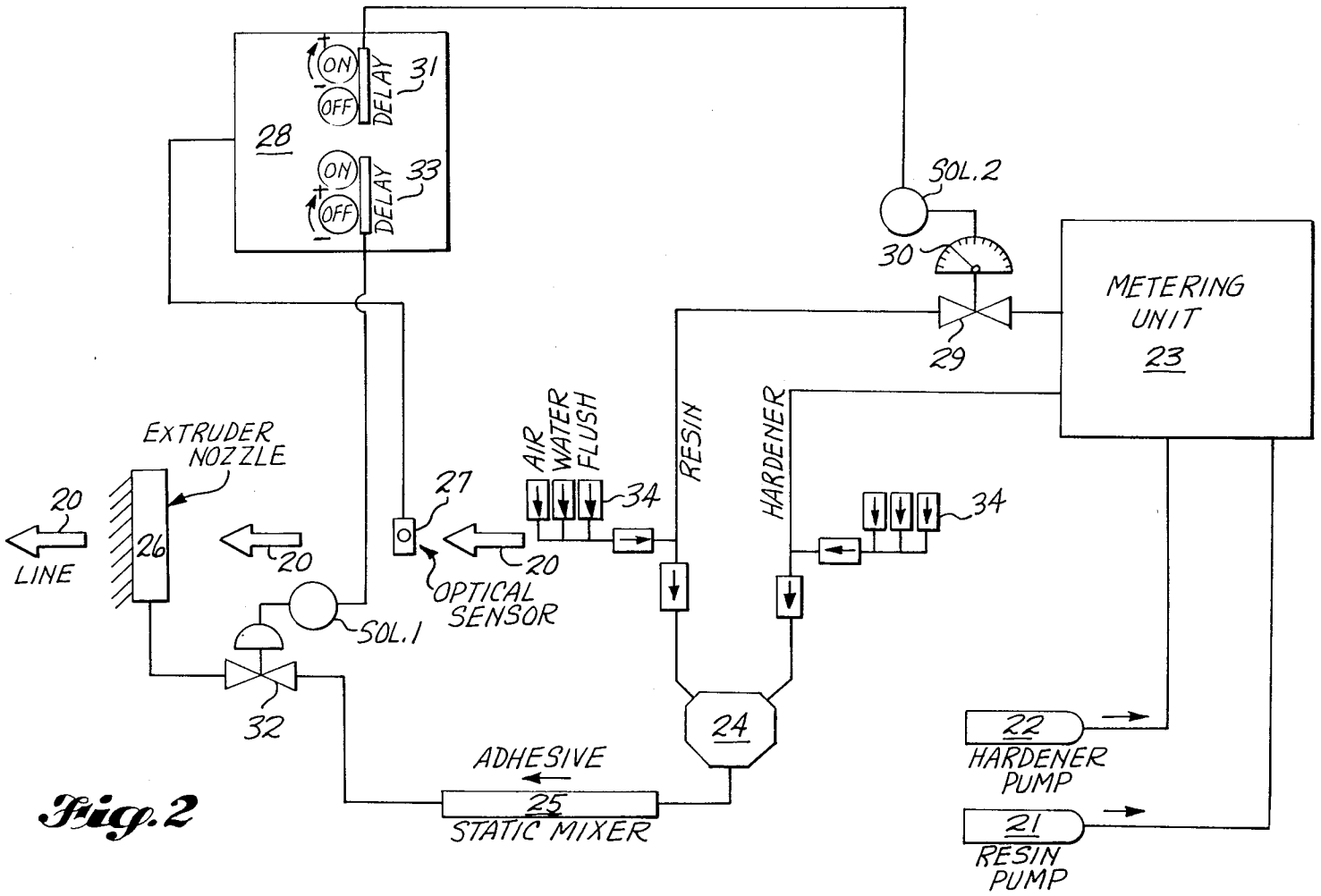
FIG. 2 is a schematic flow diagram of the control scheme of the invention.

Reference is first made to FIG. 2 which shows the general arrangement for mixing and continuously applying a two-component adhesive directly onto a workpiece represented by arrows 20. The adhesive of interest comprises a 2½ part by weight phenol-resorcinol resin and 1 part by weight of solid hardener slurried with water. Separate supply pump systems 21, 22 supply resin and hardener at constant pressure to a metering unit 23. Each pump system includes an accumulator and pressure switches to start and stop the pumps so that the supply lines always operate at constant pressure. The mixing unit 23, more fully described below, proportions the components, delivering them under pressure from the supply pumps to a specially designed mixing head 24 where the resin and hardener slurry first come together. From this mixing head, the mixture passes through a static mixer 25 which blends the two components intimately. From the static mixer 25 the adhesive passes through an extruder head or nozzle 26 onto a workpiece such as a wood plank or laminated beam component which is moving by conveyor under the extruder head.

A dual-channel optional sensor 27 of a type conventionally used for Hi-Low detection senses the leading and trailing edges of the workpiece. A dual channel amplifier 28 is connected to the sensor. A modulating pneumatic-operated ball valve 29 with a positioner 30 on one amplifier channel 31 controls flow of resin just after the metering unit. A pneumatic-operated ball valve 32 connected to the second amplifier channel 33 is located just before the extruder head.

The extruder head 26 upstream static pressure is controlled by the adjustment of each channel's respective "on" and "off" delay switches. In operation, not only is the initial adhesive pressure controlled as the extruder valve first opens, but the continual spread rate of adhesive is maintained evenly throughout the entire passage of the wood workpiece by operation of the modulating control ball valve 29. The on/off delay switches in the dual channel amplifier 28 allow a staged shutdown of the control valves which virtually eliminate adhesive overrun at the trailing edge of the board. Since the last valve is substantially on the extruder head 26, all lines remain full and at pressure at all lines and post-oozing of adhesive is prevented.

The mixing head 24 is specially designed in conjunction with a flushing system 34 to eliminate manual cleanout. Referring to FIG. 5, hardener enters the mixing head 24 through channel 35 into a contact chamber 36. Resin enters the contact chamber through channel 37. The position of the resin entry port relative to that of the hardener is designed to prevent, by flow dynamics, any infiltration of resin into the hardener channel at shutdown.

Figure 3:
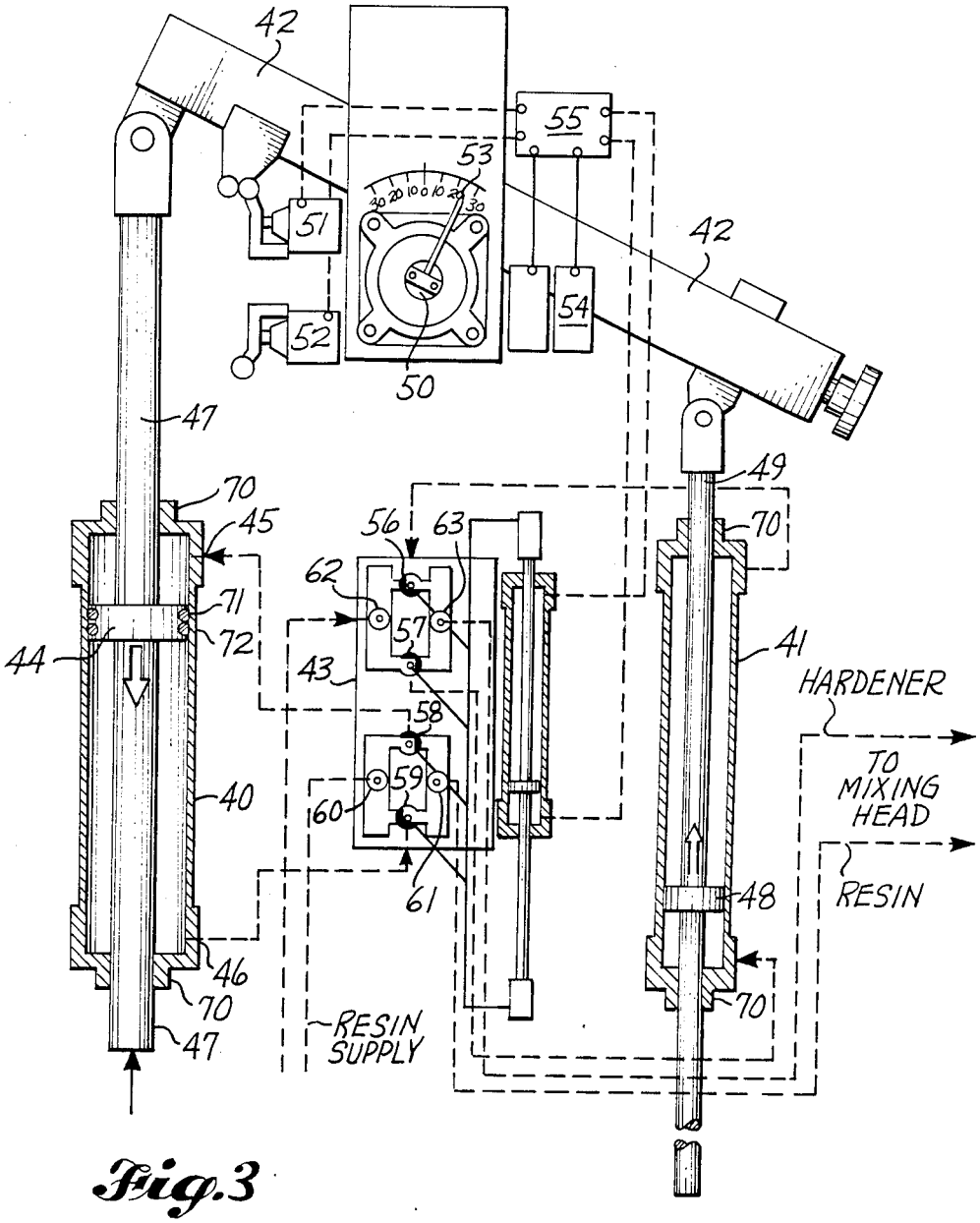
FIG. 3 is a schematic elevational view of the apparatus metering unit.

The metering unit 23 is shown in detail in FIGS. 3 and 4. The principal elements of the unit are two double acting cylinder pumps 40, 41 which pump resin and hardener, respectively; a beam 42 interconnecting the cylinders to lock in a desired delivery ratio of hardener to resin; and a specially designed valve assembly 43 which regulates the flow of resin and hardener to and from the cylinders.

Cylinder 40 is provided with a piston 44 of a diameter and stroke sufficient to deliver a desired flow of resin for the adhesive-making process shown in FIG. 2, for example. The cylinder is provided with two ports 45, 46 each for receiving and discharging resin. Cylinder rod 47 is connected to one end of the beam 42.

Cylinder piston 48 of cylinder 41 is sized to deliver a flow of hardener sufficient to produce adhesive when combined with the resin flow from the resin cylinder 40. Cylinder rod 49 is connected to the end of beam 42 opposite the resin cylinder.

An adjustment mechanism (not shown) permits moving the resin and hardener cylinder rods 47, 49 along the beam so exact adjustment of hardener to resin proportion can be made.

The beam 42 interconnecting the cylinders 40, 41 is mounted on a frame supported pivot 50. Two frame mounted limit switches 51, 52 control the arc through which the beam moves, which arc is indicated by pointer 53. A timer 54 and pneumatic controller 55 (not shown in detail) control the number of cycles per minute of the beam 42 and hence system output.

The heart of the metering unit is a valve assembly 43 which controls flow of both resin and hardener to and from the two cylinder pumps 40, 41. The valve assembly 43 includes four 3-way valves 56, 57, 58, 59, two each controlling flows to each of the cylinder pumps. In FIGS. 3–4, the lower two valves 58, 59 control resin flow while the upper two valves 56, 57 control hardener flow.

With respect to resin flow to and from the resin cylinder 40 valve assembly port 60 receives resin from the resin supply pump 21 (shown in FIG. 2). The resin piston 44 is moving, as shown by the arrow, downwardly. Thus, valve 58 is open to receive resin from the resin supply pump and open to deliver resin to fill the resin cylinder through its upper cylinder port 45. The cylinder is discharging resin on its downward stroke through lower cylinder port 46, through 3-way valve 59 and subsequently through the valve assembly 43 discharge port 61 where it proceeds to mixing head 24 (as shown in FIG. 2).

Hardener flow is controlled similarly by the upper two valves 56, 57. Hardener is admitted through a supply port 62 and discharged to the mixing head through a discharge port 63.

Each 3-way valve in the valve assembly 43 is operated by a valve handle 64. These valve handles are in contact with a roller plate 65 including rollers 66 which constrain movement of the valve handles 64. The roller plate 65 is confined to move vertically by guide shafts (not shown) which operates in conjunction with the valve assembly body 43.

The roller plate is connected to a double acting air cylinder 67. The air cylinder is operated by the same timer 54 and controller 55 which controls beam 42 cycling.

At the end of the downward or exhaust stroke the timer/controller 54, 55 will actuate the air cylinder 67 causing the roller plate 65 to move vertically upward. This action will reverse all the 3-way valves 56–59 so that resin and hardener flows with respect to each cylinder will be reversed as the beam 42 moves upwardly, with reference to cylinder 40.

The preferred control system uses a pneumatic timer/controller 54, 55 and associated valves. Combined with the valve assembly 43 design, action is cushioned and extremely fast acting. Pulsation of the adhesive flow during reversal of the system is substantially reduced in comparison with conventional spool designs. The 3-way ball valves preferred for the valve assembly feature a desirable overlap during actuation that results in a positive downstream pressure which is essential for the direct adhesive application discussed above with reference to FIG. 2.

Of critical importance to proper long-term operation of the unit is a pressurized lubrication system for gland bearings 70 and a balanced pressure water purge between piston lip seals 71, 72. Both cylinder rod 47, 49 and bearing lives have been greatly extended and piston lip seal performance has been greatly improved.

In the piston lip seal water purge, cylinder rods 47, 49 and pistons 44, 48 are bored to provide a passageway for a flow of pressurized water. A flow of 0.1 to 1 drop of water per stroke provides sufficient cleansing to prevent the buildup of material on walls or in the seals. The gland bearings are provided with a pressurized flow of light oil to keep them clear of infiltrating material.

I claim:

1. A control system for application of a two-component adhesive to a workpiece used in the manufacture of laminated wood structural members during movement of such workpiece in an operating line, comprising in combination means for supplying a liquid resin under pressure, means for supplying a liquid hardener under pressure, metering means for separately receiving, proportioning and delivering such liquid resin and liquid hardener under pressure, means for controlling delivery of metered liquid resin and liquid hardener under pressure as determined by supply pressure of such liquid resin and liquid hardener, mixing means for receiving and mixing such liquid resin and liquid hardener as proportioned by such metering means and mixing such components to form a two-component adhesive for delivery from such mixing means under pressure as determined by the supply pressures of such liquid resin and liquid hardener, extruder means for receiving such two-component adhesive including an extruder head with valve means for controlling discharge of such two-component adhesive, means for controlling on-off operation of such extruder head valve means to control discharge of such two-component adhesive, conveyor means for movement of a workpiece beneath such extruder means for application of such two-component adhesive, and optical sensing means for detecting the presence of a workpiece beneath such extruder means, such sensor means having a dual output for controlling delivery of liquid resin and hardener from such metering means to such mixing means and for controlling on-off operation of such extruder head valve means for discharge and application of such two-component adhesive to such workpiece only during passage of such workpiece beneath such extruder means.

* * * * *